United States Patent [19]

Distler et al.

[11] Patent Number: 4,771,495

[45] Date of Patent: Sep. 20, 1988

[54] BEDDING SPRING MATTRESS

[75] Inventors: William J. Distler, Lexington; Mark M. Hadley, High Point, both of N.C.; Ted D. Cowan, Carthage, Mo.

[73] Assignee: Leggett & Platt, Incorporated, Carthage, Mo.

[21] Appl. No.: 79,264

[22] Filed: Jul. 29, 1987

[51] Int. Cl.[4] ..... A47C 23/04; A47C 23/30

[52] U.S. Cl. ..... 5/478; 5/446; 5/464; 267/93

[58] Field of Search ..... 5/478, 475, 446, 447, 5/464; 267/91, 93, 95

[56] References Cited

U.S. PATENT DOCUMENTS

| | | | |
|---|---|---|---|
| 2,798,233 | 7/1957 | Robell . | |
| 2,945,244 | 7/1960 | Lincoln | 5/475 |
| 2,979,739 | 4/1961 | Krakauer . | |
| 3,089,154 | 5/1963 | Boyles | 267/93 |
| 3,430,275 | 3/1969 | Janapol | 5/447 |
| 3,590,405 | 7/1971 | Kerr . | |
| 3,828,378 | 8/1974 | Flam | 5/464 |
| 3,911,511 | 10/1975 | Higgins et al. . | |
| 3,995,337 | 12/1976 | Gershaw . | |
| 4,100,631 | 7/1978 | Slone . | |
| 4,112,726 | 9/1978 | Adams et al. . | |
| 4,124,041 | 11/1978 | Higgins . | |
| 4,180,877 | 1/1980 | Higgins . | |
| 4,358,097 | 11/1982 | Zapletal et al. . | |
| 4,426,070 | 1/1984 | Garceau | 267/91 |
| 4,445,547 | 5/1984 | Aronson . | |
| 4,488,712 | 12/1984 | Higgins . | |
| 4,555,097 | 11/1985 | Hiatt . | |
| 4,625,349 | 12/1986 | Higgins . | |

*Primary Examiner*—Reinaldo P. Machado
*Attorney, Agent, or Firm*—Wood, Herron & Evans

[57] ABSTRACT

A bedding mattress including a spring assembly, the length of which is divided into three zones, the center zone of which includes rows of springs, each row of which is formed from a single continuous length of wire and contains a plurality of coils interconnected alternately in the top and bottom planes of the spring assembly to springs of the same row. The end zones include rows of coils, each coil of which is independent of the adjacent coil and is formed of a single length of wire knotted at the ends to form a knotted end turn or revolution. The rows of coils in all zones are interconnected by helical lacing wires, and the rows of the center zone, which are located adjacent the rows of the end zones, are also interconnected by helical lacing wires. Three border wires surround and are connected to the edge-most springs of the assembly by helical lacing wires.

6 Claims, 3 Drawing Sheets

8a
9
8b
4
12
12a
21
21a
3
32
31
2a
30
2

BEDDING SPRING MATTRESS

This invention relates to bedding mattresses, and more particularly, to bedding mattresses having zones of varying firmness.

Mattresses are often constructed so as to have zones of varying firmness throughout the length of the mattress. Generally, there are three such zones, the endmost ones of which are soft or less firm relative to the more firm center zone. Mattresses are so zoned in order to provide greater comfort, as well as therapeutic support for persons sleeping on the mattress. There is a greater concentration of weight in the center section of the mattress, and consequently, greater firmness in that area generally maintains the spine of a person sleeping on a mattress straighter than if the mattress is of equal firmness throughout its length.

There have been several different techniques utilized in order to create mattresses of increased firmness in the center longitudinal third of the mattress. One technique has been to apply a wire grid or frame over the center section of the mattress. The presence of the grid or frame ties together the springs in the center section so that one spring cannot be depressed without carrying with it the adjacent springs. Thus, all of the springs which are covered or interconnected by the wire grid or frame act as a unit to resist deflection when a vertical load is applied thereto. The area which has no such grid or frame over it in turn is capable of individual spring deflection, and therefore has less firmness when a load is applied in that area. One patent which discloses a mattress reinforced or zoned in this manner is U.S. Pat. No. 4,180,877.

Another practice which has been utilized to increase the firmness in the center section of a mattress has been one of increasing the number of springs or the density of springs in the center section of a mattress relative to the end sections. That area or wherein there is a greater concentration of springs is firmer than the area wherein the springs are spaced a greater distance apart. U.S. Pat. No. 4,488,712 is illustrative of one mattress wherein a greater density of springs has been utilized to increasing the firmness of the center zone relative to the end zones of a mattress.

Yet another technique which has been employed to increase the firmness of one zone of a mattress relative to another zone has been to tie together the adjacent coils in one zone and leave unconnected or disconnected the springs in another zone. That zone wherein the springs are all interconnected is firmer than the zone wherein the springs are unconnected or disconnected. U.S. Pat. No. 4,625,849 represents an example of this type of approach to varying the firmness of differing zones of a mattress.

There have also been prior bedding box springs or bedding foundations wherein the center section of the box spring was of greater firmness than the end sections. A box spring or bedding foundation is used as a support for a mattress. Consequently, it is generally constructed so as to have some resiliency, but much less than that of the mattress which rests atop the box spring or foundation. Because resiliency and flexibility are not nearly so critical in a bedding box spring or bedding foundation as they are in a bedding mattress, foundations usually incorporate many fewer springs than spring mattresses, and those springs of a box spring or foundation are generally much firmer than mattress springs.

One approach which has been used to vary the firmness of differing zones of a box spring has been to utilize springs of heavier gauge in the center section or zone than in the end zones. Thereby, the center zone has been made firmer than the end zones. This same approach has been used to vary the firmness of mattresses.

Box springs have also been made of differing zone firmness by utilizing springs of differing types or configurations in the different zones. For example, coil springs have been used in one zone and modular or torsion type springs of greater firmness in another zone to obtain zones of differing firmness in a box spring.

In general, techniques which have been employed to obtain zones of differing firmness in box springs have not been carried over and utilized in bedding mattresses because mattresses have so many springs, and the springs are so connected in mattresses that in order to be economical and practical, the spring assembly of the mattress must be capable of machine manufacture. In other words, the springs of a mattress must generally be capable of being automatically located in an assembly machine and then automatically interconnected with adjacent springs. Box springs, on the other hand, because they have many fewer springs and because they are not required to be nearly as resilient as mattresses, are generally manually assembled or at least partially manually and partially mechanically assembled. Consequently, the techniques utilized to obtain zones of varying firmness in a box spring or bedding foundation are not appropriate for use in mattresses. For example, the practice of utilizing combinations of coil springs and torsion springs to achieve varying degrees of firmness in a box spring, have not been carried over and used in a mattress because such combinations of springs would not give rise to the requisite resiliency characteristics for a mattress, and such springs could not be mechanically and automatically positioned and assembled into an economically practical mattress product.

It has therefore been one objective of this invention to provide an economically practical mattress which has zones of differing firmness created by differing types of springs in the different zones of a mattress.

Still another objective of this invention has been to provide an economically practical mattress which has zones of differing firmness created by utilization of differing types of springs within the differing zones, and which springs may be machine assembled by currently available or only slightly altered, currently available assembly equipment.

These objectives are achieved and this invention is predicated upon the concept of a mattress having a center zone and end zones of differing firmness. The center zone is made from a plurality of rows of coil springs wherein each row is formed from a single continuous length of wire, and each of the rows contains a plurality of coils interconnected by interconnecting segments with alternate ones of the interconnecting segments being disposed in the top and bottom planes of the mattress and with the rows of coils being interconnected by helical lacing wires. The end zones of the mattress also include a plurality of rows of coil springs, but those coil springs are independent coil springs, each manufactured from its own independent length of wire with the ends of the wires wrapped or "pigtailed" around the last turn or revolution of the coil spring. The rows of independent coils in the end zones are connected to adjacent rows by helical lacing wires. Helical lacing wires also connect the endmost rows of coils in the center zone to the adjacent rows of coils in the endmost zones. One preferred mattress made in accordance with this invention includes three border wires, one of which is located in the plane of the top surface of the spring assembly and another of which is located in the plane of the bottom surface of the spring assembly. The third border wire is located intermediate the first and second border wires and is parallel thereto. All three border wires are laced or otherwise connected to the edgemost springs in the assembly by helical lacing wires.

The primary advantage of a mattress made in accordance with this invention is that it has zones of varying firmness constructed from springs of differing, and yet economical, manufacture, and it is still capable of machine manufacture and assembly on machinery which is currently available and which requires very little modification to accommodate these differing springs.

These and other objects and advantages of this invention will become more readily apparent from the following description of the drawings in which.

Figure 1:
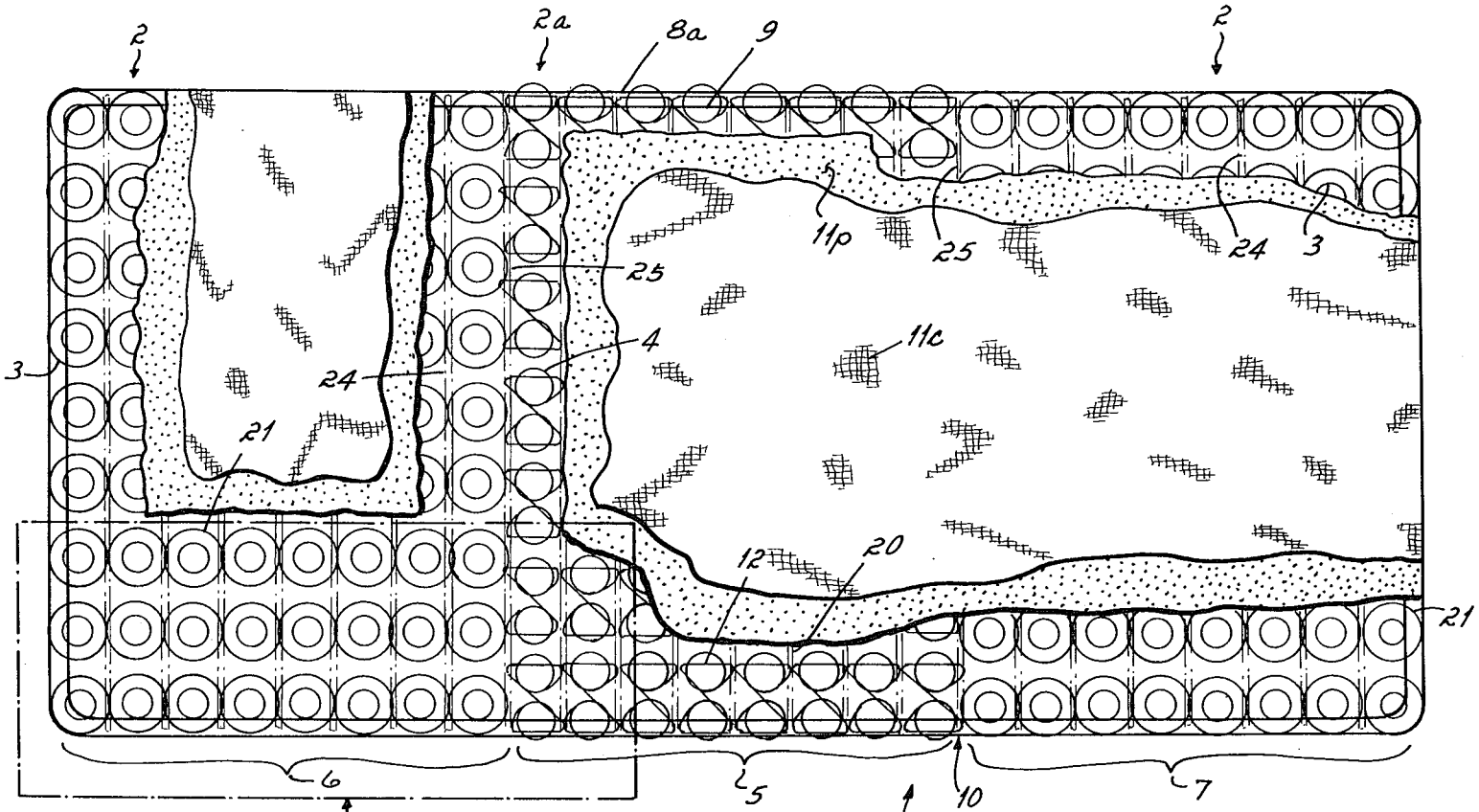
FIG. 1 is a top plan view, partially broken away, of a mattress incorporating the invention of this application.
Figure 2:
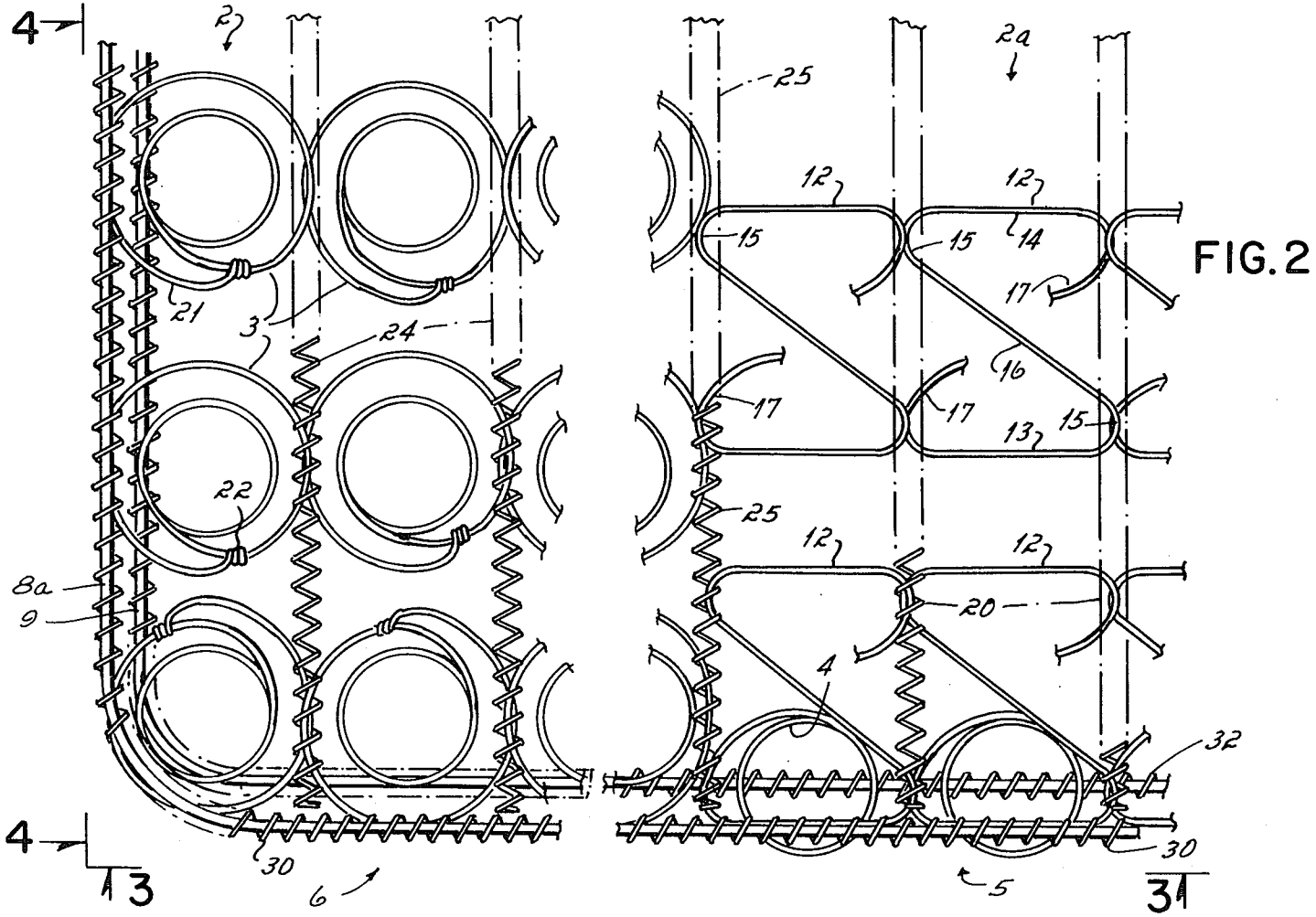
FIG. 2 is an enlarged top plan view of one corner of the mattress of FIG. 1.

With reference first to FIGS. 1 and 2, it will be seen that the mattress 1 of this invention comprises a rectangular spring assembly 10 which has padding 11*p* covering the top and bottom surfaces of the spring assembly. This padding 11*p*, along with the spring assembly 10, is encased within an upholstered covering 11*c* as is conventional in mattress manufacture.

The spring assembly 10 comprises a plurality of transverse rows 2, 2*a* of coil springs 3 and 4. Those rows 2, 2*a* of coil springs are divided into three zones: A center zone 5, as well as end zones 6 and 7. Each of these zones extends for the full width of the mattress and occupies approximately one-third of the length of the mattress. As explained more fully hereinafter, the illustrated embodiment of the mattress 1 includes three border wires 8*a*, 8*b* and 9 which surround the spring assembly 10. Each border wire is rectangular in configuration and is secured to the edgemost springs of the spring assembly. One such border wire 8*a* is located in the plane of the top surface of the spring assembly 10 of the mattress. Another border wire 8*b* is located immediately beneath the upper border wire 8*a* in the plane of the bottom surface of the spring assembly 10. A third border wire 9 is located intermediate the two border wires 8*a* and 8*b*. This centermost border wire 9 is located approximately medially of the height of the spring assembly 10 and is secured to the same edgemost springs.

While the illustrated embodiment of the invention utilizes three border wires, there are applications of the invention which may utilize only the top and bottom border wires or no border wires at all. One such application of the invention which employs no border wires at all is as a mattress for a sofa sleeper. In that application, the mattress must be folded when not in use. The zones of varying firmness in the mattress of this invention are particularly suited to use in a sofa sleeper mattress where a firm center section is desired and a softer end section creates a desirable soft seating section when the mattress is folded and used to support seat cushions.

In accordance with the invention of this application, the rows 2*a* of coil springs 4 located in the center zone 5 of the mattress 1 comprise a single length of wire having multiple coils formed therein and interconnected alternately in the top and bottom planes of the spring assembly 10 by connector segments 12, 12*a* of the rows 2*a* of coil springs 4. In the illustrated embodiment, each of these connector segments is generally Z-shaped in configuration. These rows 2*a* of coils in this zone 5 are manufactured in accordance with the disclosure and are laced to adjacent rows of the zone 5 in accordance with the disclosure of U.S. Pat. No. 3,911,511, assigned to the assignee of this application. For purposes of completely describing these rows of coil springs and the manner in which they are manufactured and assembled, the disclosure of this patent is hereby incorporated by reference.

Figures 3, 4:
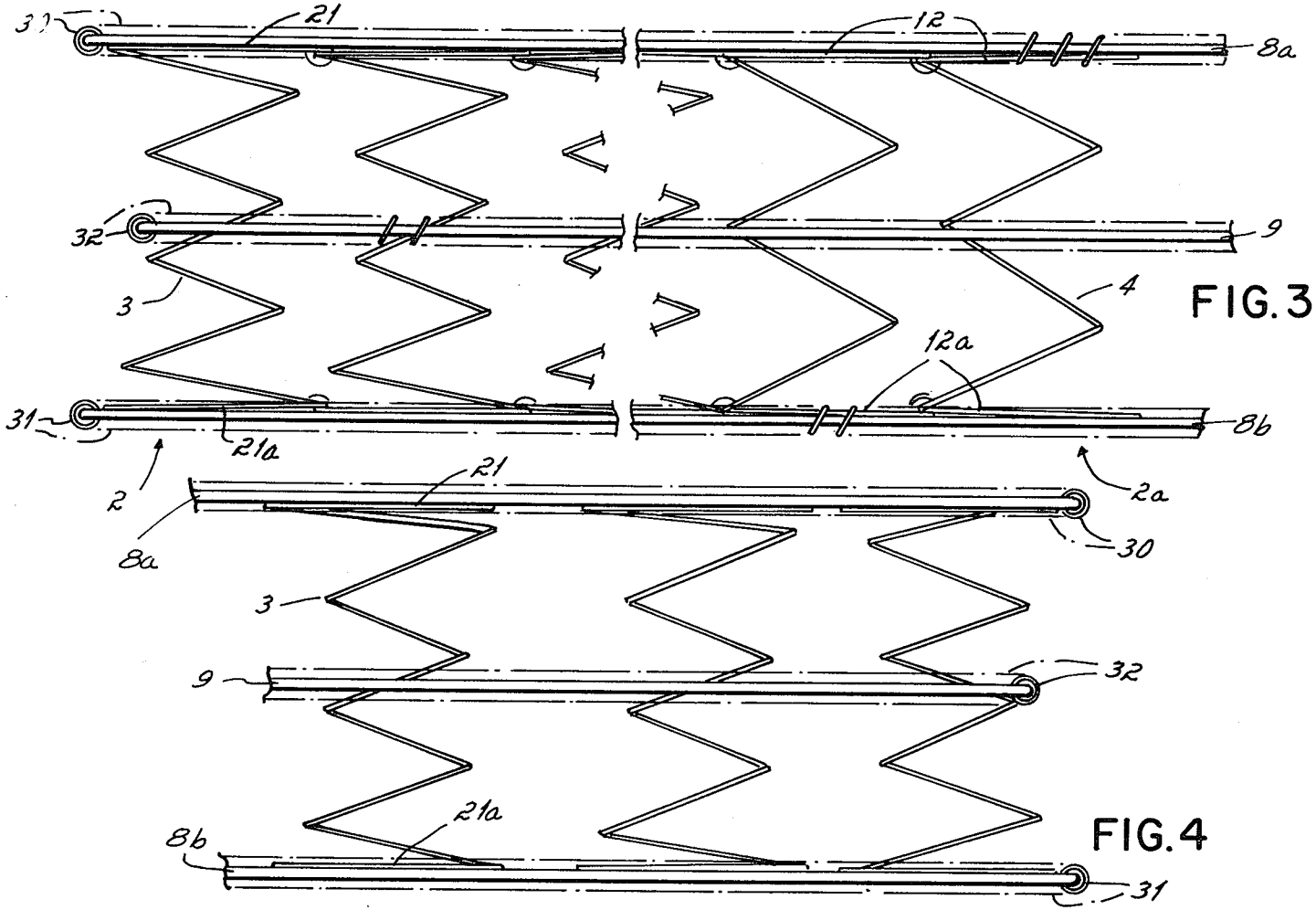
FIG. 3 is a side elevational view taken on line 3—3 of FIG. 2.
FIG. 4 is an end elevational view taken on line 4—4 of FIG. 2.

With reference particularly to FIGS. 2 and 3, it will be seen that adjacent coils 4 of each row 2*a* in the center zone 5 are joined to adjacent coils by generally Z-shaped planar connector segments 12 in the upper plane of the spring assembly. An identical connector segment 12*a* joins lower ends of alternate adjacent coils 4 of each row in the plane of the lower surface of the coil spring assembly. This alternating upper, then lower, connection of adjacent coils 4 in each row is continuous from one end of the row and from one side of the spring assembly 10 to the other side. With particular reference to FIGS. 1 and 2, it will be seen that the Z-shaped planar connector segments 12, 12*a* each contain a pair of parallel end legs 13, 14 interconnected by a radiused section 15 to a diagonally extending crossbar 16. These legs 13, 14 and diagonal crossbar 16 are all located in common horizontal planes of the upper and lower surfaces of the mattress. The legs 13 and 14 are connected at the end opposite the connection to the diagonal crossbar 16, to the coils 4 by a radiused end section 17. The coils 4 are generally helical and of constant diameter throughout their length. In one preferred embodiment of the invention, the coils are of approximately two full revolutions between the Z-shaped connector segments 12, 12*a* at the opposite ends thereof. The number of revolutions contained in the coil, though, may vary from one application to another.

The legs 13 and 14 of the Z-shaped connector segments are of approximately the same or slightly greater length than the diameter of the coils 4. The radiused corners 15 and 17 of the ends of the legs 13 and 14 of the Z-shaped connector segment therefore extend beyond the diameter of the coils on both sides of the coil. To assemble adjacent rows 2*a* of the center zone 5 of the spring assembly 10, the radiused corners 15, 17 of adjacent rows are overlapped, and the overlapped rows are laced together by helical lacing wires 20 which extend from adjacent one end of the row to adjacent the other end of the row. These helical lacing wires 20 wrap around the overlappeded radiused ends 15, 17 of adjacent rows so as to connect the rows of coils into a coil matrix arranged in rows and columns within the center zone 5.

The coil springs 3 in the end zones 6 and 7 of the mattress are also arranged in rows and columns. These coil springs, though, are independent coil springs unconnected one with the other except by helical lacing wires 24. They are not interconnected at the top and bottom to adjacent coils of the same row in the manner of the coils in the center zone 5. Instead, each coil terminates in an end revolution 21, 21*a* located in the top and bottom planes of the spring assembly 10. The length of wire of which these coils 3 are manufactured terminates at each end in a knot 22 which is wrapped around the end of the adjacent turn or revolution of the coil 3. Between the end turns or revolutions 21, 21*a*, each coil preferably has three and one-half additional helical turns or revolutions of wire of decreasing diameter toward the vertical center of the spring. Because of their decreasing diameter toward the center, the helical coil springs 3 are generally referred to as hourglass in shape and are commonly referred to in the trade as "Bonnell" springs.

The independent coil springs or "Bonnell" springs in the end zones 6 and 7 of the spring assembly 10 are spaced apart transversely and are slightly overlapped with springs of adjacent rows. The springs 3 are laced together by helical lacing wires 24 which extend transversely from one end of a row to the other for the full width of the spring assembly 10. These lacing wires wrap around overlapped portions of the coils in adjacent rows so as to secure the independent coil springs to the coils of an adjacent row in an overlapped relationship and to the coils of the same row in a spaced relationship. Thereby, the rows and columns of coils 3 within the end zones 6, 7 are secured together to form the matrix having end turns or revolutions located in the top and bottom planes of the coil spring assembly 10 and an axis located perpendicular to the planes of the top and bottom surfaces of the spring assembly.

In the practice of this invention, the endmost row of coils in an end zone 6 or 7 is positioned against or adjacent the endmost row of coils 2*a* of the center section 5 with the edgemost portion of a top and bottom revolution or turn 21, 21*a* of a coil 3 longitudinally overlapped relative to a radiused connector section 15, 17 of Z-shaped interconnecting segments 12 of the endmost row of coils 2*a* in the center section. With the rows so overlapped, a helical lacing wire 25 is wrapped around the overlapped sections so as to secure the end zones 6 and 7 of independent coil springs 3 to the center zone section 5 of rows 2*a* of continuous interconnected springs 4. Thereby, a spring assembly 10 is formed wherein the center zone section has different resilient characteristics than the end zone section, but all three zones have coil springs therein, the end turns or revolutions of which or the interconnecting segments of which are all located in common top and bottom horizontal planes of the spring assembly. In the preferred practice of this invention, the center zone is approximately 30 percent more firm than the end zone when a vertical load is placed atop the zones and forced downwardly against the resiliency of the springs in that zone.

In the illustrated embodiment of this invention, there are three border wires 8*a*, 8*b* and 9 surrounding and defining the edges of the box spring assembly 10. The uppermost one of these border wires 8*a* is rectangular in configuration and is connected to the edgemost springs in the end zones 6 and 7 and the center zone 5 by a helical lacing wire 30 wrapped around the border wire and the edgemost portion of the coil springs 3 and connector segments in the end zones of the mattress. In the center zone of the mattress, the border wire 8*a* is attached to the edgemost leg 13 or 14 of the end connector segment 12 of each row of coil springs. Similarly, the bottom border wire 8*b* is connected by a helical lacing wire 31 to the edges of the coil springs 3 in the end zones 6, 7 of the coil and to the endmost connector segments of the rows of coils 2*a* in the center zone 5 of the mattress. The bottom border wire 8*b* is located immediately below and in the same vertical plane as the upper border wire 7.

The third border wire 9 extends around the periphery of the spring assembly 10 medially of the top and bottom planes of the assembly. This border wire 9 is also rectangular in configuration, but is slightly shorter in length and narrower in width than the top and bottom border wire 8*a* and 8*b*. Because it is smaller in dimension, it may be attached to the helical coil section of the coil springs 3 and 4 in the end zones and center zone of the mattress by means of a helical lacing wire 32 which wraps around the border wire and around the coil springs at the points at which the border wire contacts the coil springs.

While I have described only a single preferred embodiment of my invention, persons skilled in the art to which this invention pertains will appreciate changes and modifications which may be made without departing from the spirit of my invention. Therefore, I do not intend to be limited except by the scope of the following appended claims:

We claim:

1. A bedding mattress comprising a rectangular spring assembly having a length and width, as well top and bottom surfaces, said length of said spring assembly being divided into at least three rectangular zones, each of which extends for the full width of said assembly and for a portion of the length thereof, said zones comprising a center zone and a pair of end zones, a plurality of rows of springs located within each of said zones, each of said rows of springs extending transversely across the full width of said spring assembly, the rows of springs located within at least one of said zones, each being formed from a single continuous length of wire and each of said rows containing a plurality of coils interconnected by interconnecting segments, alternate ones of said interconnecting segments being disposed in the planes of said top and bottom surfaces of said spring assembly, said coils having axes, the axes of said coils being disposed perpendicular to the planes of said top and bottom surfaces of said spring assembly, sections of each of said interconnecting segments of each row of springs in said one zone being located adjacent interconnecting segments of an adjacent row, and first helical spring means extending parallel to said rows of springs in said one zone for the full width thereof, said first helical spring means being wound through said adjacent sections of said interconnecting segments so as to secure said rows of coils in an assembled relation, the rows of springs located within at least one of said other zones each comprising a plurality of independent coil springs having top and bottom revolutions located in the planes of said top and bottom surfaces of said spring assembly, said independent coil springs each being made from a single length of wire, the opposite ends of which are knotted and attached to the top and bottom revolutions of the coil, and second helical spring means extending parallel to said rows of independent coil springs in said one other zone so as to secure said top and bottom revolutions of independent coil springs located in adjacent rows of springs in said one other zone in an assembled relation, third helical spring means extending parallel to said rows and connecting interconnecting segments of a row of springs in an endmost row of springs in said one zone with top and bottom revolutions of coil springs in an endmost row of coil springs in said one other zone, padding covering said top and bottom surfaces of said spring assembly, and an upholstered covering material encasing said spring assembly and said padding.

2. A rectangular spring assembly having a length and width, as well top and bottom surfaces, said length of said spring assembly being divided into at least three rectangular zones, each of which extends for the full width of said assembly and for a portion of the length thereof, said zones comprising a center zone and a pair of end zones, a plurality of rows of springs located within each of said zones, each of said rows of springs extending transversely across the full width of said spring assembly, the rows of springs located within at least one of said zones, each being formed from a single continuous length of wire and each of said rows containing a plurality of coils interconnected by interconnecting segments, alternate ones of said interconnecting segments being disposed in the planes of said top and bottom surfaces of said spring assembly, said coils having axes, the axes of said coils being disposed perpendicular to the planes of said top and bottom surfaces of said spring assembly, sections of each of said interconnecting segments of each row of springs in said one zone being located adjacent interconnecting segments of an adjacent row, and first helical spring means extending parallel to said rows of springs in said one zone for the full width thereof, said first helical spring means being wound through said adjacent sections of said interconnecting segments so as to secure said rows of coils in an assembled relation, the rows of springs located within at least one of said other zones each comprising a plurality of independent coil springs having top and bottom revolutions located in the planes of said top and bottom surfaces of said spring assembly, said independent coil springs each being made from a single length of wire, the opposite ends of which are knotted and attached to the top and bottom revolutions of the coil, and second helical spring means extending parallel to said rows of independent coil springs in said one other zone so as to secure said top and bottom revolutions of independent coil springs located in adjacent rows of springs in said one other zone in an assembled relation, and third helical spring means extending parallel to said rows and connecting interconnecting segments of a row of springs in an endmost row of springs in said one zone with top and bottom revolutions of coil springs in an endmost row of coil springs in said one other zone.

3. The spring assembly of claim 2 wherein said springs of said one zone and said springs of said one other zone differ in firmness and resiliency when a load is placed on the top surface of said spring assembly.

4. The spring assembly of claim 3 wherein said one zone is said center zone of said spring assembly.

5. The spring assembly of claim 2 which further includes three border wires, one of said border wires being located in said plane of said top surface of said spring assembly, another of said border wires being located in said plane of said bottom surface of said spring assembly, and said third border wire being located in a plane intermediate but parallel said top and bottom planes, said border wires all being connected to said spring assembly by helical lacing wire means.

6. The spring assembly of claim 5 wherein said first border wire is connected to interconnecting segments of rows of coils in said one zone and to top revolutions of coils in said one other zone, said second border wire being connected to interconnecting segments of rows of coils in said one other zone and to bottom revolutions of coils in said one other zone, and said third border wire being connected to helical sections of coils in both of said zones.

* * * * *